US006814242B2

(12) United States Patent
Masukane et al.

(10) Patent No.: US 6,814,242 B2
(45) Date of Patent: Nov. 9, 2004

(54) ROTATIVELY OSCILLATING SEPARATOR

(75) Inventors: Hideaki Masukane, Chiyoda-Ku (JP); Shigeki Kinoshita, Chiyoda-Ku (JP); Masashi Kageyama, Chiyoda-Ku (JP); Chozaburo Ikuta, Chiyoda-Ku (JP); Haruyoshi Yamaguchi, Chiyoda-Ku (JP)

(73) Assignee: Satake Corporation, Tokyo (JP)

( * ) Notice: Subject to any disclaimer, the term of this patent is extended or adjusted under 35 U.S.C. 154(b) by 180 days.

(21) Appl. No.: 10/202,061

(22) Filed: Jul. 25, 2002

(65) Prior Publication Data

US 2003/0019799 A1 Jan. 30, 2003

(30) Foreign Application Priority Data

Jul. 26, 2001 (JP) ..... 2001-226483

(51) Int. Cl.[7] ..... B07C 9/01

(52) U.S. Cl. ..... 209/691; 209/365.1; 209/365.4; 209/366; 209/274; 209/777

(58) Field of Search ..... 209/365.1, 365.4, 209/366, 274, 275, 276, 277, 691

(56) References Cited

U.S. PATENT DOCUMENTS

| | | | | | |
|---|---|---|---|---|---|
| 676,419 | A | * | 6/1901 | Carter | 209/14 |
| 897,489 | A | * | 9/1908 | Prinz | 209/691 |
| 2,464,216 | A | | 3/1949 | Devol et al. | |
| 2,822,090 | A | * | 2/1958 | Johnston | 209/481 |
| 3,217,561 | A | * | 11/1965 | Allgaier et al. | 74/600 |
| 3,581,598 | A | * | 6/1971 | Allgaier et al. | 74/600 |
| 4,077,873 | A | * | 3/1978 | McKibben | 209/332 |
| 4,269,703 | A | * | 5/1981 | Bruderlein | 209/243 |
| 5,542,548 | A | | 8/1996 | Senapati | |
| 6,250,479 | B1 | * | 6/2001 | Satake et al. | 209/691 |
| 6,460,704 | B2 | * | 10/2002 | Satake et al. | 209/480 |

FOREIGN PATENT DOCUMENTS

| | | |
|---|---|---|
| JP | 60-36399 | 10/1985 |
| JP | 2000-343042 | 12/2000 |

* cited by examiner

*Primary Examiner*—Donald P. Walsh
*Assistant Examiner*—Jonathan R Miller
(74) *Attorney, Agent, or Firm*—Nixon Peabody, LLP; Donald R. Studebaker

(57) ABSTRACT

A rotatively oscillating separator comprising separating vessels 4 each having cone-shaped separating plate 5 disposed in the vessel, and drive means 6 for rotatively oscillating said separating vessels 4, mixed rice consisting of unhulled rice and unpolished rice being fed onto the separating plates in the separating vessels at a given location to separate the unhulled rice and the unpolished rice from each other, the unpolished rice being discharged through raised peripheral portions of the vessels, and the unhulled rice being discharged through the central bottoms of the separating vessels. The drive means comprises a plurality of oscillatory drives provided at locations equi-angularly spaced around the separating vessels 4, said oscillatory drives each being upwardly inclined and operatively connected to the raised peripheral portion of the separating vessel to support it, said oscillatory drives being sequentially actuated at predetermined phases of delay to generate oscillatory motion to be imparted to the separating vessels, said each oscillatory drive including an oscillatory angle adjusting mechanism 40 for retaining the oscillatory drive at the upward inclination and for varying an oscillatory angle in the rotative oscillation of the separating vessels.

8 Claims, 8 Drawing Sheets

ROTATIVELY OSCILLATING SEPARATOR

FIELD OF THE INVENTION

This invention relates to oscillating separators for separating unhulled rice and unpolished rice from each other after hulling rice, and more particularly, a rotatively oscillating separator for separating unhulled rice and unpolished rice from each other by rotatively oscillating a cone-shaped separating plate.

BACKGROUND OF THE INVENTION

The applicant has proposed in Japanese Patent Application Heisei 11-156994 a rotatively oscillating separator for separating mixed rice into unhulled rice and unpolished rice by rotatively oscillating a cone-shaped separating plate composed of a plurality of segments. This rotatively oscillating separator comprises a vertical rotating shaft, a drive for rotatively driving the shaft, a plurality of eccentric portions on the rotating shaft, the eccentric shaft portions being offset a predetermined distance from the axis of the rotating shaft, circular separating vessels each rotatably mounted on each of the eccentric shaft portions and having a cone-shaped separating plate contained therein, retaining means for preventing the separating vessels from freely rotating, and means for adjusting an angle of inclination of the separating plate segments. There is provided a level sensor for sensing the thickness of a layer of mixed rice on the separating plate, an outlet from the sensor being sent to a controller to control the angle adjusting means for the separating plate segments, thereby maintaining the layer of mixed rice at a predetermined thickness.

The rotating oscillating separator of this type has a disadvantage that each of the separating vessels requires the use of angle adjusting means for the separating plate segments, this resulting in increase in manufacture costs. Since the adjusting means is disposed below the separating plate, the two adjacent separating plates are required to have enough space therebetween to accommodate the adjusting means. This makes it difficult to arrange the entire rotatively oscillating separator into a compact configuration.

Japanese Utility Model Publication Sho 60-36399 discloses a grain oscillating separator comprising grain separating plates inclined laterally, rocking arm means for oscillating the separating plates, and means for varying an rocking angle θ 2 of the rocking arm means on the upstream side in the lateral direction of the separating plates, without varying an angle of inclination α of the separating plates. The variation of rocking angle makes it optimum to separate the mixed rice into unhulled rice and unpolished rice while the mixed rice flowing longitudinally on the separating plates. However, this arrangement can not be applied to cone-shaped separating plates.

SUMMARY OF THE INVENTION

An object of the invention is to provide a rotatively oscillating separator of the type which rotatively oscillates separating vessels each having a cone-shaped separating plate, comprising oscillatory angle adjusting mechanisms for varying an oscillatory angle in rotative oscillation of the separating vessels.

A further object of the invention is to provide a rotatively oscillating separator including a plurality of separating vessels arranged in a compact and stacked relation.

These objects of the invention can be achieved by providing a rotatively oscillating separator comprising at least one separating vessel having a raised peripheral portion and a cone-shaped separating plate disposed in the vessel, and drive means for rotatively oscillating said separating vessel, mixed rice consisting of unhulled rice and unpolished rice being fed onto the separating plate in the separating vessel at a given location to separate the unhulled rice and the unpolished rice from each other, the unpolished rice being discharged through the raised peripheral portion of the vessel, and the unhulled rice being discharged through the central bottom of the separating vessel, characterized in that said drive means comprises a plurality of oscillatory drives provided at locations equi-angularly spaced around the separating vessel, said oscillatory drives each being upwardly inclined and operatively connected to the raised peripheral portion of the separating vessel to support it, said oscillatory drives being sequentially actuated at predetermined phases of delay to generate oscillatory motion to be imparted to the separating vessel, said each oscillatory drive including an oscillatory angle adjusting mechanism for retaining the oscillatory drive at the upward inclination and for varying an oscillatory angle in the rotative oscillation of the separating vessel.

As mixed rice is fed onto the separating plate of the separating vessel during rotative oscillation of the separating vessel, unpolished rice which is small in grain size and is great in specific gravity, is carried on the separating plate towards the raised peripheral portion of the separating vessel under the action of centrifugal force to exit the separating vessel through an unhulled rice discharge port. The unhulled rice which is large in grain size and less in specific gravity, slips off the separating plate so that it passes through the central portion of the separating plate. In case that the coefficient of friction, moisture, and specific gravity of rice as in different kinds of rice, take place, change, the oscillatory angle adjusting mechanisms may be operated to vary the angle of oscillation in the rotative oscillation of the separating vessel, thereby separating the mixed rice into unpolished rice and unhulled rice on the separating plate under an optimum condition.

In a preferred embodiment of the invention, each oscillatory drive is provided in a support frame pivotally connected to a framework of the separator by means of pivot pins and includes a motor, a gearbox for transmission of rotation from the motor, a driving shaft having at its top a crank-pin and connected to an output shaft of the gearbox, a oscillatory plate having an eccentric shaft and rotatably connected to the crank-pin, and means for preventing the oscillatory plate from revolving together with the crank-pin, and further comprising means for operatively connecting said oscillatory drive to said separating vessel, said means including a connecting member resiliently connected to the raised peripheral portion of the separating vessel and having mounting hub, and a follower rotatably connected to said eccentric shaft. Each of said oscillatory angle adjusting mechanisms includes an adjusting screw mechanism for rotating the support frame around the pivot pins to vary the inclination of the support frame. Each adjusting screw mechanism includes a internally threaded element freely movably mounted in the support frame, a vertical adjusting screw rod rotatably mounted in the framework for the rotatively oscillating separator and having a externally threaded portion threaded into the internally threaded element, and a hand-wheel for rotating the adjusting screw rod.

As the hand-wheel is rotated, the action of the screw between the external threads of the adjusting screw rod and the internally threaded element permits the support frame to be rotated around the pivot pins, thereby varying the angle of inclination of the oscillatory drive. Thus, the oscillatory angle of the separating vessel can be quickly and readily adjusted.

In a further preferred embodiment of the invention, the adjusting screw mechanisms include a rotation transmitting mechanism including sprockets on the adjusting screw rods and a chain engaged around the sprockets to rotate the adjusting screw rods in a synchronized relation.

In another embodiment, each adjusting screw mechanisms includes a internally threaded element rotatably mounted in the framework, a support element having an enlarged through-hole formed therein, and rotatably mounted in said support frame, an adjusting screw rod extending through said enlarged through-hole and having an externally threaded portion threaded into said internally threaded element, and lock nut means for fixedly holding said adjusting screw rod in place. With the lock nut means loosen, the adjusting screw rod is rotated to move it relative to the internally threaded element, thereby varying the angle of inclination of the oscillatory drive. Thus, the oscillatory angle of the separating vessel can be quickly and readily adjusted.

In a further preferred embodiment of the invention, there are provided a plurality of separating vessels disposed in a vertically stacked relation, a plurality of sets of upper and lower oscillatory drives are provided at locations equi-angularly spaced around the separating vessels, said upper and lower oscillatory drives of each set, are operatively connected through said connecting member and resilient joints to said separating vessels and include a common oscillatory angle adjusting mechanism for retaining the oscillatory drives at the upward inclination and for varying an oscillatory angle in the rotative oscillation of said separating vessels.

In a still further preferred embodiment of the invention, there are provided a plurality of separating vessels disposed in a vertically stacked relation, a plurality of sets of upper and lower oscillatory drives are provided at locations equi-angularly spaced around the separating vessels, each of said upper and lower oscillatory drives of each set, is operatively connected through said connecting member and resilient joints to said stacked separating vessels and includes an individual oscillatory angle adjusting mechanism for retaining the oscillatory drive at the upward inclination and for varying an oscillatory angle in the rotative oscillation of said separating vessels.

BRIEF DESCRIPTION ON THE DRAWINGS

DETAILED DESCRIPTION ON THE INVENTION

An embodiment of the invention is described hereinafter in detail with reference to the accompanying drawings. Although in the present embodiment, a rotatively oscillating separator for mixture of unhulled rice and unpolished rice is described, it may be employed for separation of wheat and impurities, rubber and impurities, small chips of wood and impurities, buckwheat and buckwheat shells, and plastics and impurities.

Figure 1:
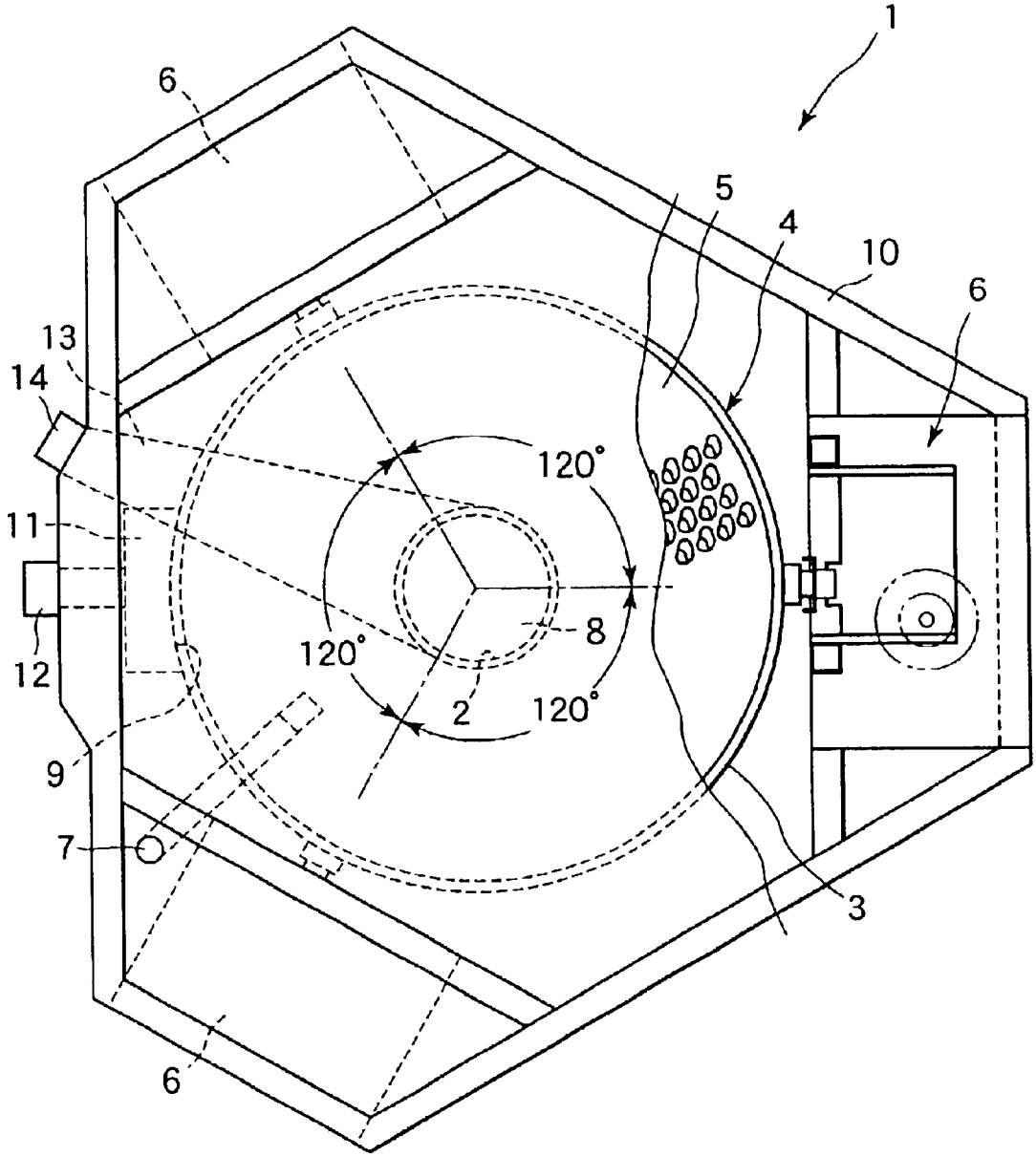
FIG. 1 is a schematic top plan view of a rotatively oscillating separator constructed in accordance with the invention.
Figure 2:
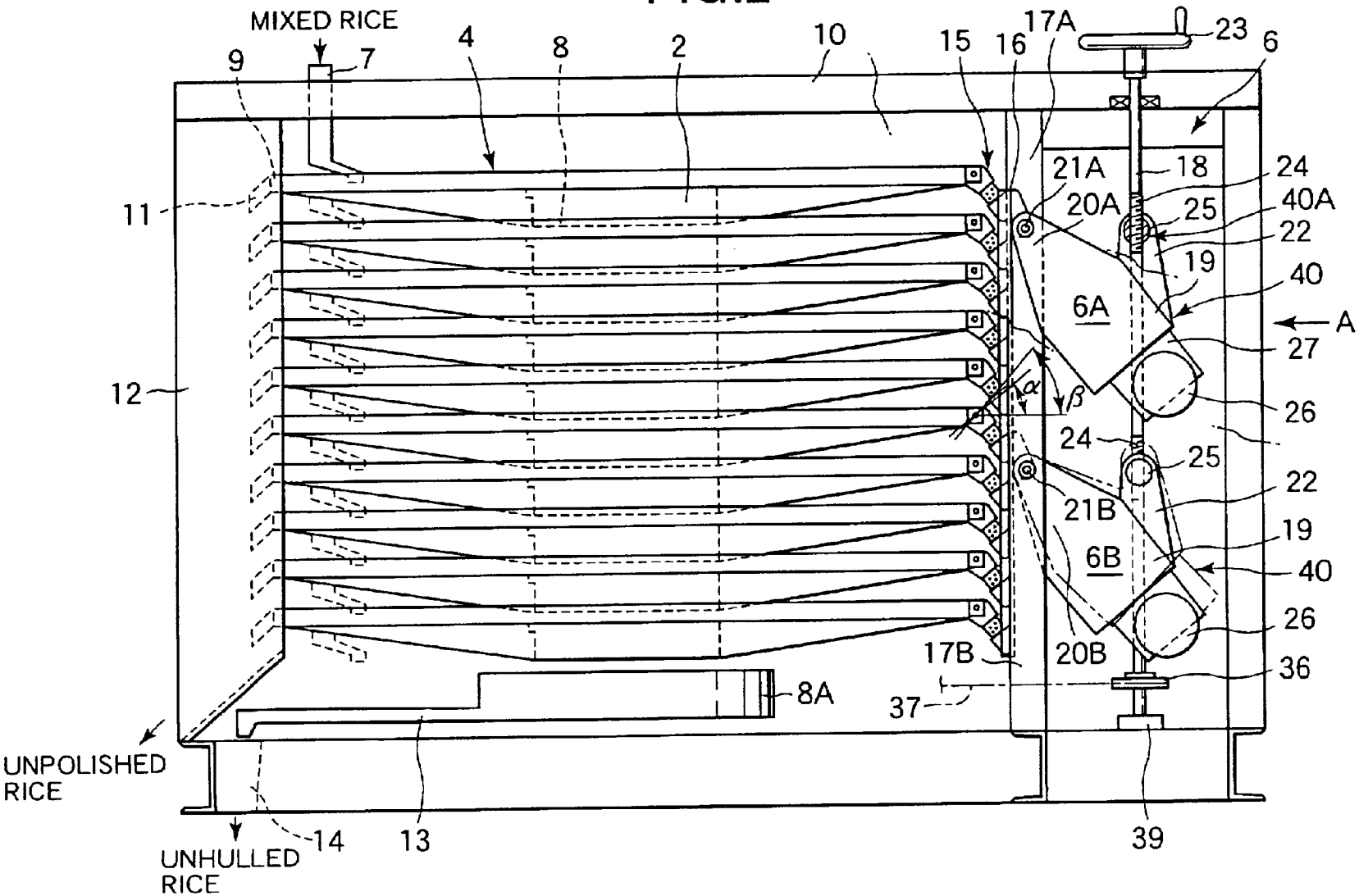
FIG. 2 is a schematic side elevation view of the rotatively oscillating separator.

FIG. 1 is a schematic top plan view of the rotatively oscillating separator constructed in accordance with the invention and FIG. 2 is a schematic side elevation view of the rotatively oscillating separator. Referring to FIGS. 1 and 2, the rotatively oscillating separator 1 comprises a plurality of separating vessels disposed in a vertically stacked relation and each having a raised peripheral portion 3 and a cone-shaped separating plate 5 with its central bottom 2, the separating plate having a number of small recesses formed on the surface thereof, drive means 6 for rotatively oscillating the separating vessels, feed means 7 for feeding mixed rice consisting of unhulled rice and unpolished rice, onto the separating plates 5, circular unhulled rice discharge portions 8 for discharging the unhulled rice through the central portions 2 of the separating plates 5, unpolished rice discharge ports 9 for discharging unpolished rice through the raised peripheral portions 3 of the separating vessels 4. Unpolished rice discharge trough 11 is provided to be in communication with the discharge port 9 in the raised peripheral portion 3 of each of the separating vessels 4, and unpolished rice from each of the unpolished rice discharge troughs 11 exits the separator through a common unpolished rice shaft 12. Unhulled collecting portion 8A is provided below the lowest of the staked separating vessels for collecting the unhulled rice from the unhulled rice discharge portions and has a unpolished rice discharge trough 13 connected thereto. Unhulled rice from the discharge trough 13 exists the separator through another discharge trough 14.

Figure 3:
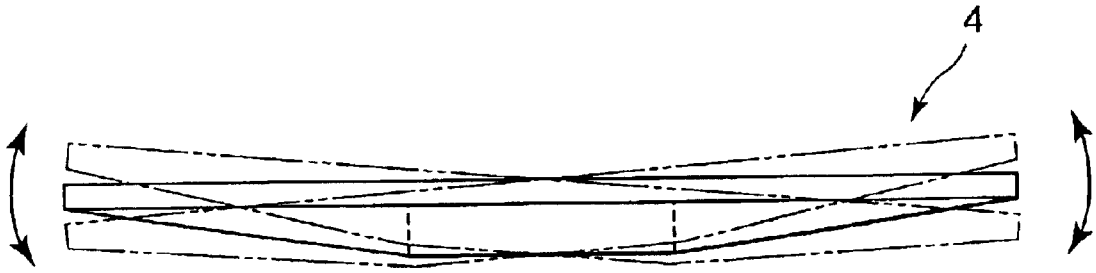
FIG. 3 is a schematic view representative of oscillatory motion of separating vessels.

Drive means 6 comprises a pair of upper and lower oscillatory drives 6A and 6B provided at each of three locations spaced equi-angularly (in this case, through 120 degree) around the separating vessels (see FIGS. 1 and 2). Oscillatory drives 6A and 6B each is mounted on a support frame 19 having its arms 20A, 20B pivotally connected to vertical supports 17A, 17B of a framework 10 of the separator by means of pivot pins 21A, 21B, and retained in an upwardly inclined position by means of an oscillatory angle adjusting mechanism 40. The oscillatory drives of each pair are operatively resiliently connected to the raise peripheral portions of the separating vessels to support them. Three pairs of the oscillatory drives are sequentially actuated in predetermined delayed phases to generate elliptical oscillatory motion which is transmitted through the operative resilient connection to the stacked separating vessels so that wave-like rotative oscillatory motion is imparted to each of the separating vessels (see FIG. 3). The operative resilient connection can be accomplished by connecting the peripheral portion 3 of each of the separating vessels 4 through resilient joints 15 of urethane rubber to a vertically elongate connecting member 16 which is connected to the upper and lower oscillatory drives of each pair.

Figure 4:
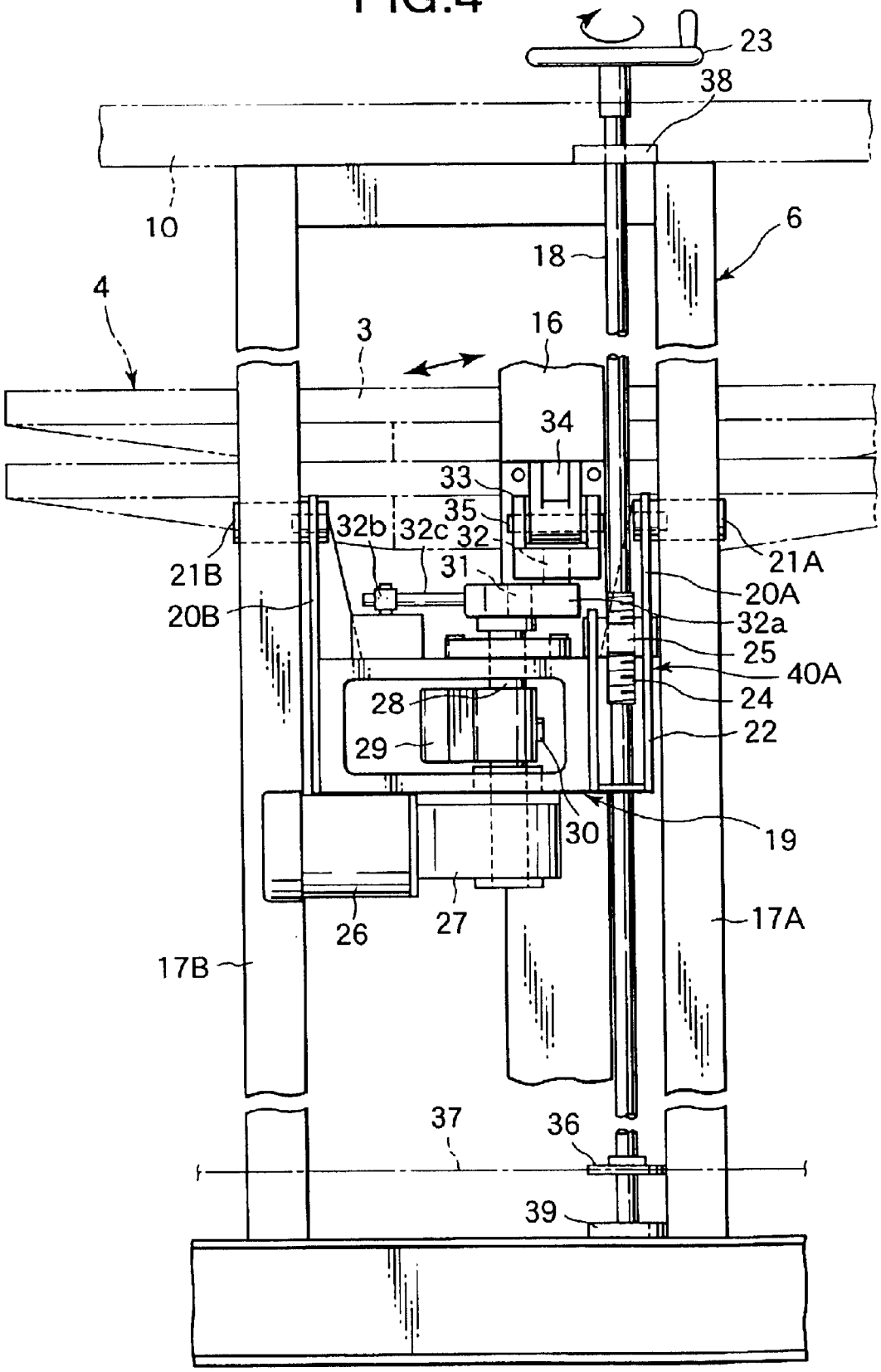
FIG. 4 is a schematic elevation view as viewed from arrow A in FIG. 2.
Figure 5:
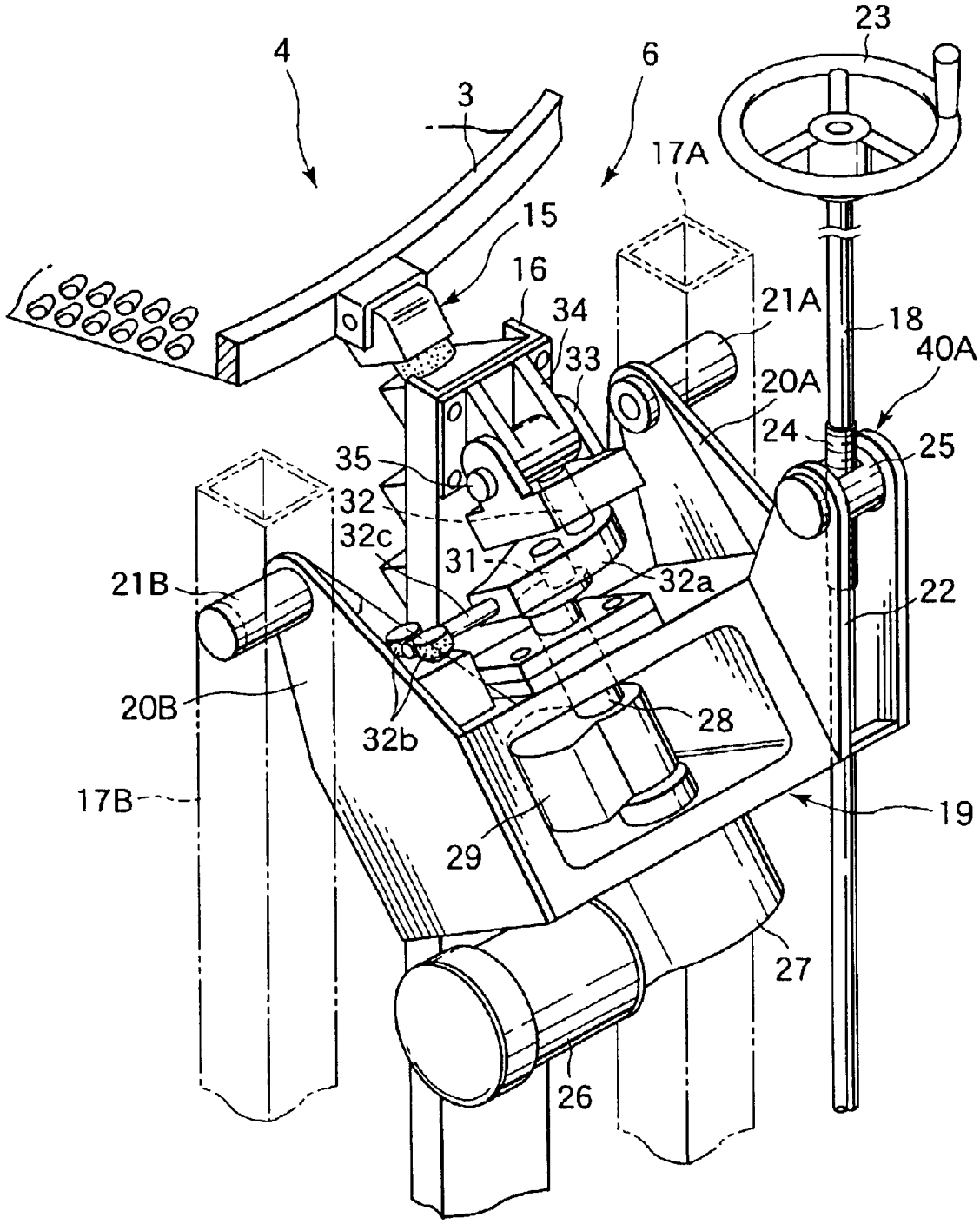
FIG. 5 is a perspective view of an oscillatory drive in the rotatively oscillating separator.
Figure 7:
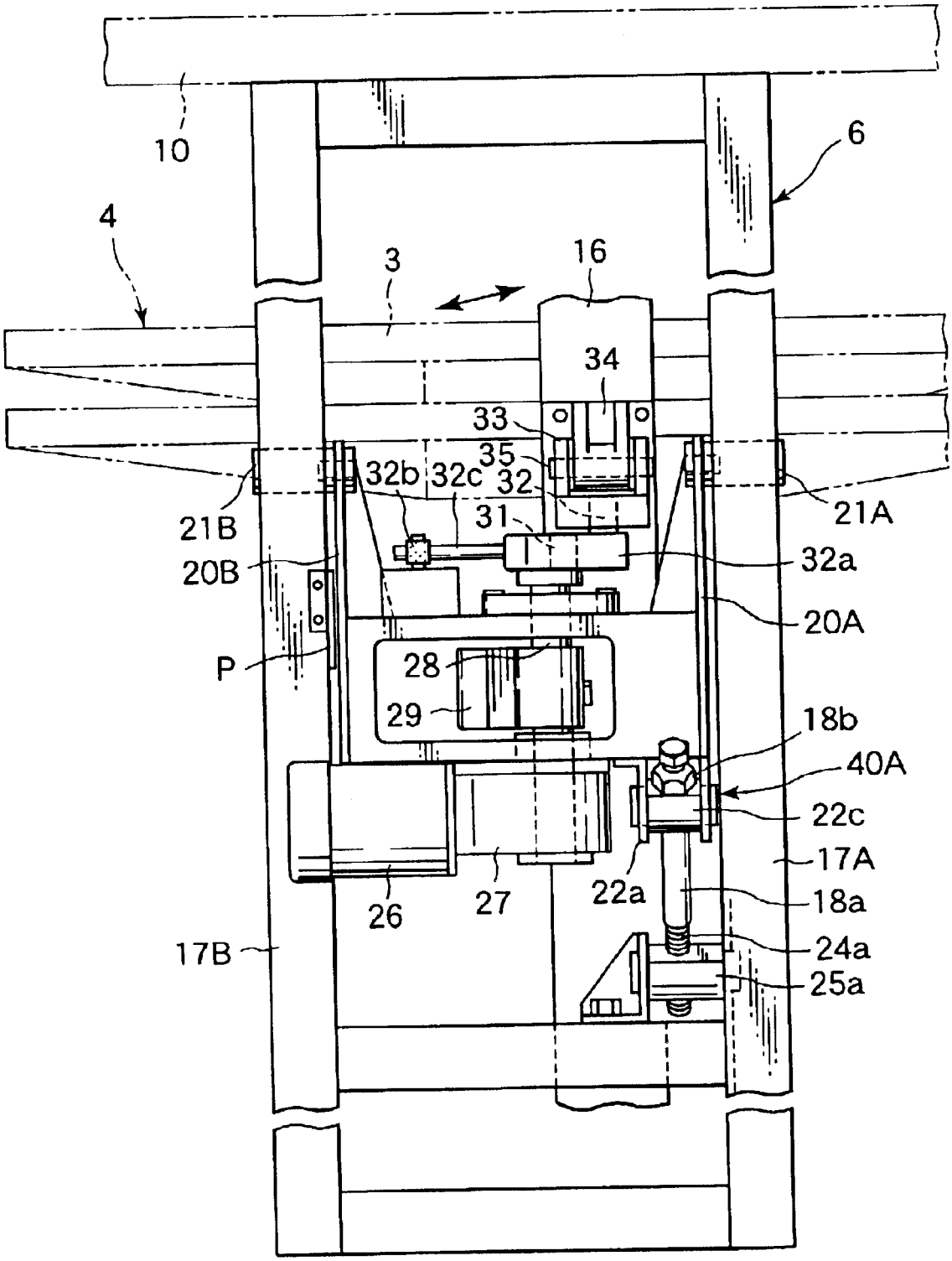
FIG. 7 is a schematic elevation view as viewed from arrow B in FIG. 6.

Referring to FIGS. 4, 5, and 7, Each of the oscillatory drives 6A, 6B includes a motor 26 and a gearbox 27 fixed to the bottom of the support frame 19, a driving shaft 28 connected to an output shaft of the gearbox 27 and mounted in the support frame for rotation, the driving shaft 28 being provided at its top with a crank-pin 31, a counterweight 29 fixed to a lower portion of the driving shaft 28 by a set-screw 30, a oscillatory plate 32*a* rotatably connected to the crank-pin 31 on the driving shaft 28 and having an eccentric shaft 32, and means for preventing the oscillatory plate 32*a* from revolving together with the crank-pin in order to permit the eccentric shaft 32 to describe an elliptical trace. The preventing means comprises a rod 32*c* extending from the oscillatory plate 32*a* and a pair of rubber rollers 32*b*, 32*b* rotatably mounted on the support frame 19, between which the rod 32*c* is movably retained. The eccentric shaft 32 is rotatably received from below in a follower 33 which is pivotably connected to a mounting hub 34 by means of a pin 35. The mounting hub 34 is secured to the connecting member 16. The pin 35 is aligned with the pivot pins 21A,21B such that the follower 33 can be pivoted around the pin 35 in the mounting hub 34 upon pivotal movement of the support frame 19 around the pivot pins 21A, 21B.

Rotation of the motor 26 is transmitted through the gearbox 27 to the driving shaft 28 to revolve the crank-pin 31 around the axis of the driving shaft 28, thereby rotatively oscillating the oscillatory plate 32*a*. Thus, the eccentric shaft 32 is eccentrically revolved. The eccentric revolution of the eccentric shaft 32 is transmitted to the follower 33 from which the oscillatory motion is imparted through the connecting member 16 and the resilient joints 15 to the separating vessels as indicated by an arrow in FIG. 4.

Referring to FIGS. 2, 4, and 5, the oscillatory angle adjusting mechanism 40 includes an adjusting screw mechanism 40A provided for pivotal movement of the support frames 19 around the pivot pins 21A, 21B to vary the angle of inclination of the support frames 19 for the upper and lower oscillatory drives. The adjusting screw mechanism 40A includes a vertical adjusting screw rod 18 rotatably supported in upper and lower bearings 38 and 39 mounted on the framework 10 and having externally threaded portions 24, and internally threaded elements 25 mounted in brackets 22 of the support frames 19 of the upper and lower oscillatory drives, for lateral movement relative to the brackets and threadedly engaged with the externally threaded portions 24 of the adjusting screw rod 18. The adjusting screw rod 18 is provided with a hand-wheel 23 to rotate the screw rod. Rotation of the adjusting screw rod 18 permits internally threaded elements 25 to move up and down along the screw rod 18 due to threaded engagement with its externally threaded portions 25, thereby rotating or swinging each of the support frames 19 around pivot pins 21A,21B. This can result in variation in the angle of inclination of the oscillatory drives.

Fixed to lower end portions of the adjusting screw rods 18 for three pairs of oscillatory drives are sprockets 36 around which a chain 37 is engaged to rotatively drive the screw rods simultaneously. Thus, rotation of one of the adjusting screw rods 18 is transmitted to the other two adjusting screw rods by means of the sprocket•chain in a synchronized relation so that the three adjusting screw rods 18 will have identical amount of rotation.

Figure 6:
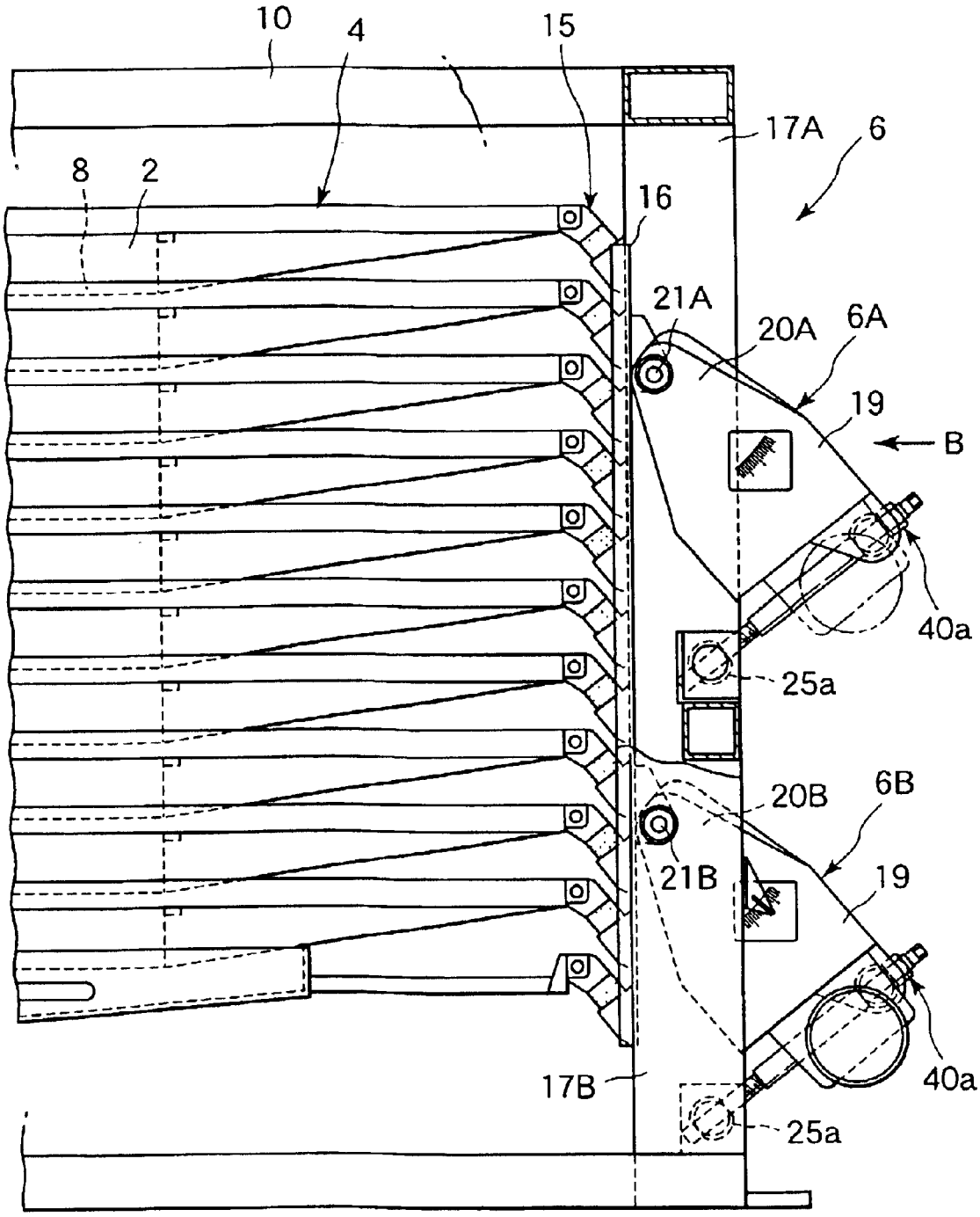
FIG. 6 is a schematic side elevation view of a modification of the rotatively oscillatory separator according to the invention.
Figure 8:
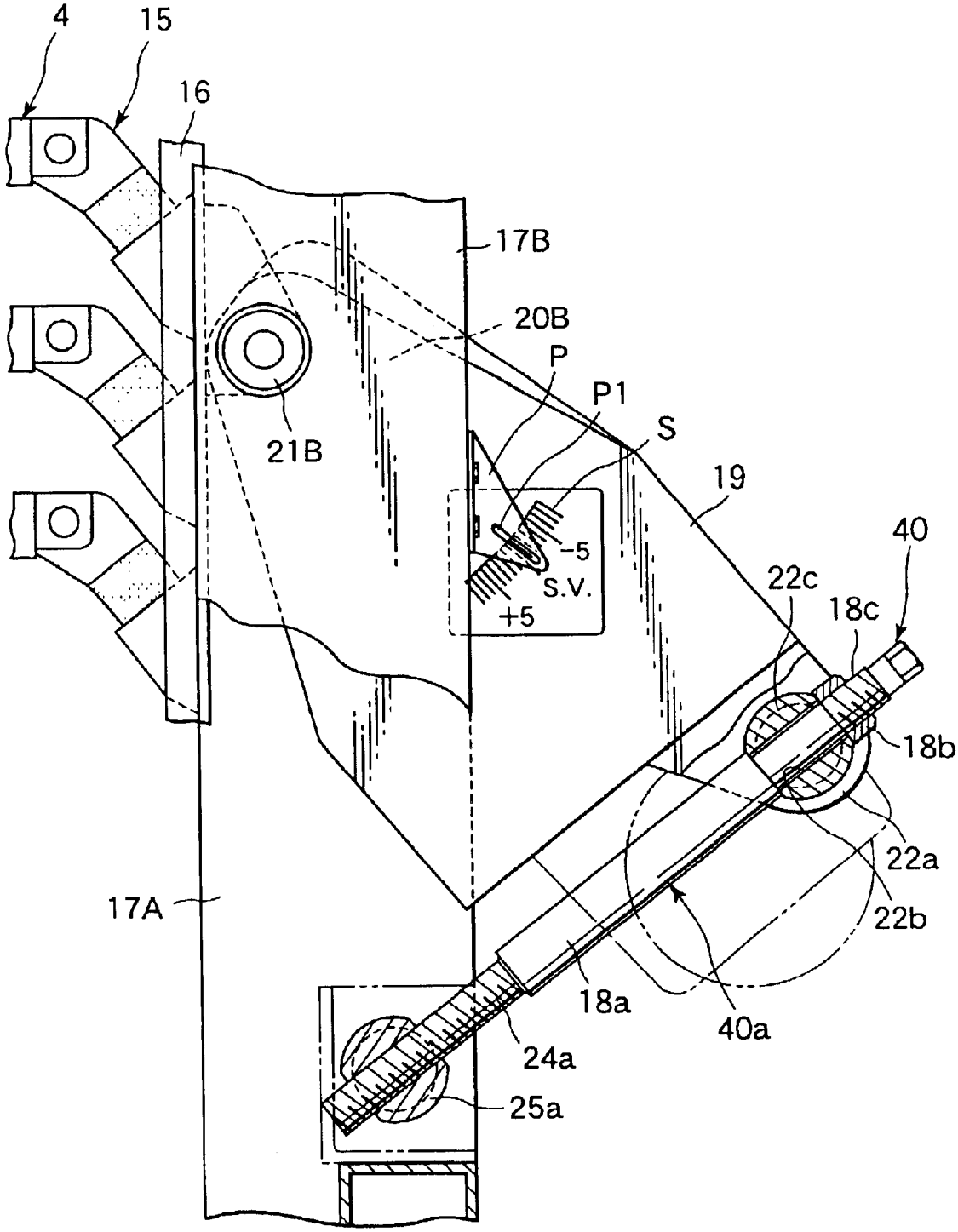
FIG. 8 is an enlarged fragmentary cross-sectional view of a portion of FIG. 6.

In a modification of the invention as illustrated in FIGS. 6, 7, and 8, a adjusting screw mechanism 40*a* is provided for each of oscillatory drives and includes an internally threaded element 25*a* rotatably mounted in a framework 10 for a rotatively oscillating separator and having internal threads, a support element 22*c* mounted in brackets 22*a* of a support frame 19 for rotation and having an enlarged through-hole 22*b* formed therein, an adjusting screw rod 18*a* having an externally threaded portion 24*a* threadedly engaged with the internal threads in the internally threaded element 25*a* while extending through the enlarged through-hole 22*b*, and lock nut means 18*b* threadedly engaged with external threads formed on the adjusting screw rod 18*a* to lock the adjusting screw rod 18*a* to the support element 22*c*. The adjusting screw rod 18*a* is preferably provided with a hexagon head which is adapted to cooperate with for example, a spanner in order to make it ease to turn the screw rod. With the lock nut 18*b* loosen, the adjusting screw rod is turned by the use of the spanner so that the external threads 24*a* are screwed into or out of the internally threaded element 25*a*. Thus, the support frame 19 is rotated or swung around pivot pins 21A,21B to be capable of varying the angle of inclination of the oscillatory drives. Thereafter, the lock nut 18*a* is tightened to hold the adjusting screw rod in place. In order to ensure that the identical angle of inclination is provided to all the oscillatory drives, angular graduations are provided on the support frame 19 while an indicator P is attached to a support of the framework 10 and has a window P1 through which one can view an alignment with an intended graduation.

Operation of the rotatively oscillating separator according to the invention will be described below. The oscillatory drives impart rotative oscillatory motion to the separating vessels 4 and mixed rice consisting of unhulled rice and unpolished rice to be separated, is fed through the feed means 7 onto the separating plates 5 of the separating vessels 4. Due to the fact that the nearer to the periphery of the vessels 5, the greater the acceleration and the separating plates 5 have a conical slope, unpolished rice which is small in grain size and is great in specific gravity, is carried radially outwardly towards the raised peripheral portion of the separating vessels on their separating plates under the action of centrifugal force so that it is discharged through unpolished rice discharge ports 9, and unpolished rice discharge troughs 11 into unpolished rice discharge shaft 12 to exist the separator. The unhulled rice which is large in grain size and less in specific gravity, slips off the separating plates 5 so that it is discharged through the central portions of the separating plates into unhulled collecting portion 8A from which the collected unhulled rice passes through unpolished rice discharge trough 13 and discharge trough 14 to exist the separator.

The ability of the rotatively oscillating separator to separate the mixed rice remains unchanged as long as physical properties such as moisture, coefficient of friction of the rice do not change. However, if changes in moisture and coefficient of friction of rice as in the case of different kinds of rice, take place, the unpolished rice can be difficult to be carried towards the periphery of the separating vessels 4. In order to increase the ability to carry the unpolished rice, operation is effected to reduce the oscillatory angle of the separating vessels. On the contrary, if unhulled rice is carried along with unpolished rice towards the periphery of the separating vessels 4, the oscillatory angle of the vessels 4 is increased for reduction in the ability to carry the mixed rice.

As the hand-wheel 23 is rotatively operated to rotate the adjusting screw rods 18 for variation in the angle of inclination of the support frames 19, the followers 33 are pivoted around the pins 35 in the mounting hubs 34 to vary the oscillatory angle of the separating vessels. It will be appreciated from FIG. 2 that the support frames 19 are angularly moved from their solid line-position to their broken line-position so that oscillatory angle $\alpha$ of the separating vessels can be increased to $\beta$.

Since according to the invention, the rotative operation of the hand-wheel results in derivation in the oscillatory angle of all the stacked separating vessels rather than varying the oscillatory angle of each of the separating vessels, the adjustment of the angle can be readily made in a short time to provide an optimum separation of the unpolished rice and unhulled rice on the separating plates. It will be appreciated that the same advantage can also be provided in the case of the modification of the invention in which adjustment of the angle of inclination of each of the oscillatory drives is made by the individual adjusting screw rod. Since the drive means are disposed around the separating vessels, a small space is only required between the two adjacent separating vessels in the case of the stacked vessels so that the entire rotatively oscillating separator can be made more compact. The rotatively oscillating separator according to the invention has a significantly improved throughput capacity as compared with a single separating vessel.

From the foregoing, it will be apparent that the present invention provides the rotatively oscillating separator such arranged that the drive means impart oscillatory motion to the stacked separating vessels and that the oscillatory angle adjusting mechanisms are capable of varying the oscillatory angle of the stacked separating vessels.

What is claimed is:

1. A rotatively oscillating separator comprising at least one separating vessel having a raised peripheral portion and a cone-shaped separating plate disposed in the vessel, and drive means for rotatively oscillating said separating vessel, mixed rice consisting of unhulled rice and unpolished rice being fed onto the separating plate in the separating vessel at a given location to separate the unhulled rice and the unpolished rice from each other, the unpolished rice being discharged through a portion of the raised peripheral portion, and the unhulled rice being discharged through a central bottom of the separating vessel, characterized in that said drive means comprises a plurality of oscillatory drives provided at locations equi-angularly spaced around the separating vessel, said oscillatory drives each being upwardly inclined and operatively connected to the raised peripheral portion of the separating vessel to support the separating vessel, said oscillatory drives being sequentially actuated at predetermined phases of delay to generate oscillatory motion to be imparted to the separating vessel, said each oscillatory drive including an oscillatory angle adjusting mechanism for retaining the oscillatory drive at the upward inclination and for varying an oscillatory angle in the rotative oscillation of the separating vessel.

2. A rotativelly oscillating separator according to claim 1, wherein said each oscillatory drive is provided in a support frame pivotally connected to a framework of the separator by means of pivot pins and includes a motor, a gearbox for transmission of rotation from the motor, a driving shaft having at its top a crank-pin and connected to an output shaft of the gearbox, an oscillatory plate having an eccentric shaft and rotatably connected to the crank-pin, and means for preventing the oscillatory plate from revolving together with the crank-pin, and further comprising means for operatively connecting said oscillatory drive to said separating vessel, said means including a connecting member resiliently connected to the raised peripheral portion of the separating vessel and having mounting hub, and a follower rotatably connected to said eccentric shaft.

3. A rotatively oscillating separator according to claim 1 or 2, wherein each of said oscillatory angle adjusting mechanisms includes an adjusting screw mechanism for rotating the support frame around the pivot pins to vary the inclination of the support frame.

4. A rotatively oscillating separator according to claim 3, wherein said each adjusting screw mechanism includes an internally threaded element freely movably mounted in the support frame, a vertical adjusting screw rod rotatably mounted in the framework for the rotatively oscillating separator and having an externally threaded portion threaded into the internally threaded element, and a hand-wheel for rotating the adjusting screw rod.

5. A rotatively oscillating separator according to claim 4, wherein said adjusting screw mechanisms include a rotation transmitting mechanism including sprockets on the adjusting screw rods and a chain engaged around the sprockets to rotate the adjusting screw rods in a synchronized relation.

6. A rotatively oscillating separator according to claim 3, wherein said each adjusting screw mechanisms includes an internally threaded element rotatably mounted in the framework, a support element having an enlarged through-hole formed therein, and rotatably mounted in said support frame, an adjusting screw rod extending through said enlarged through hole and having an externally threaded portion threaded into said internally threaded element, and means for fixedly holding said adjusting screw rod in place.

7. A rotatively oscillating separator according to claim 1, wherein there are provided a plurality of separating vessels disposed in a vertically stacked relation, a plurality of sets of upper and lower oscillatory drives are provided at locations equi-angularly spaced around the separating vessels, said upper and lower oscillatory drives of each set, are operatively connected through said connecting member and resistent joints to said separating vessels and include a common oscillatory angle adjusting mechanism for retaining the oscillatory drives at the upward inclination and for varying an oscillatory angle in the rotative oscillation of said separating vessels.

8. A rotatively oscillating separator according to claim 1, wherein there are provided a plurality of separating vessels disposed in a vertically stacked relation, a plurality of sets of upper and lower oscillatory drives are provided at locations equi-angularly spaced around the separating vessels, each of said upper and lower oscillatory drives of each set, is operatively connected through said connecting member and resilient joints to said stacked separating vessels and includes an individual oscillatory angle adjusting mechanism for retaining the oscillatory drive at the upward inclination and for varying an oscillatory angle in the rotative oscillation of said separating vessels.

* * * * *